US005815841A

United States Patent [19]

Spangrud

[11] Patent Number: 5,815,841

[45] Date of Patent: Oct. 6, 1998

[54] NOVELTY HAT INCLUDING MINIATURE BASKETBALL GOAL

[75] Inventor: Bruce D. Spangrud, Beaverton, Oreg.

[73] Assignee: Set The Curve, Inc., Little Rock, Ark.

[21] Appl. No.: 190,273

[22] Filed: Feb. 2, 1994

[51] Int. Cl.[6] ..... A42B 1/00

[52] U.S. Cl. ..... 2/195.1; 2/209.13; 273/1.5 R

[58] Field of Search ..... 2/171, 175.1, 195.1, 2/209.13, 425; 273/1.5 A, 1.5 R, 398, 399, 400, 401, 402; D2/865, 866, 868, 869, 870, 871, 872, 873, 874, 876, 879, 882, 883, 884, 886, 893, 895

[56] References Cited

U.S. PATENT DOCUMENTS

| | | | |
|---|---|---|---|
| D. 338,562 | 8/1993 | Barker et al. | D2/871 |
| D. 344,394 | 2/1994 | Livera et al. | D2/870 |
| 3,595,573 | 7/1971 | Kilbourne | 273/1.5 R |
| 4,805,903 | 2/1989 | Mc Ardle | 273/1.5 R |
| 5,275,419 | 1/1994 | Kazemi | D2/882 |

OTHER PUBLICATIONS

"Orlando Magic" hat with clear plastic backboard and goal above brim—offered for sale about 1990.

Slammin' Jammin' hat with backboard patch and net sewn in place—publicly exhibited and offered for sale on or about Jun. 12, 1992.

*Primary Examiner*—Clifford D. Crowder
*Assistant Examiner*—Diana L. Biefeld
*Attorney, Agent, or Firm*—Dickinson, Wright, Moon, Van Dusen & Freeman

[57] ABSTRACT

A novelty hat in the form of a ball cap having a visor defining an opening in which a miniature basketball net is mounted. The miniature net is held in position in the opening by a rim of molded plastic including respective flanges circumscribing the opening, on both the top and the bottom of the visor. A miniature basketball fits through the rim, but the opening in the bottom of the net is small enough to keep the ball from passing all the way down through the net. A keeper mounted on the rim is selectively movable to a position extending above a portion of the ball to hold the ball in the net and thus prevent the ball from being lost when the hat is not being worn.

13 Claims, 4 Drawing Sheets

NOVELTY HAT INCLUDING MINIATURE BASKETBALL GOAL

BACKGROUND OF THE INVENTION

The present invention relates to novelty hats, and particularly to a hat including a miniature basketball net.

It has previously been known to attach a miniature basketball goal to the front of a ball cap, as a novelty item. In one such novelty item a miniature backboard of hard transparent plastic was fastened to the front of the crown of such a hat, and a miniature basketball goal including a self-supporting rim of molded plastic and a net fashioned of small-diameter textile cord was mounted on the backboard.

In another prior art version of such a novelty item, an opening is defined through the visor of a ball cap, and a net fashioned of small-diameter textile cords is fastened in the opening in the visor by stitching similar to buttonhole stitching. Both of these previous versions of such a novelty hat, however, are prohibitively expensive to produce and market profitably.

In order to keep from losing a miniature ball intended for use with such an attached miniature basketball goal, one prior art cap has the ball tethered to the cap by a small cord. Such a cord interferes with use of the ball and goal for a game of athletic skill. Without a tether, however, the ball is likely to become separated from the cap and be lost.

What is desired, then, is a novelty hat including a miniature basketball goal which can be manufactured at a low enough cost to be profitably marketable, and preferably including a mechanism for preventing loss of the ball when necessary, without interfering with the ability to throw the ball and to catch it in the goal.

SUMMARY OF THE INVENTION

The present invention provides a novelty hat which overcomes the aforementioned shortcomings of prior art novelty hats incorporating basketball goals. In a novelty hat according to the present invention an opening is provided in the visor of a cap such as a ball cap, and a simulated basketball goal of miniature size includes a rim which may be of molded plastic and a net which may also be molded of plastic and which is supported by the rim. The rim is mounted in the opening provided in the visor of the cap, where a flange portion of the rim circumscribes the opening in the visor and rests in contact with the top surface of the visor.

In a preferred embodiment of the invention the net has a mouth adjacent the rim, and an opening defined by the rim is large enough to admit a miniature ball, but the bottom end of the net is too small for the ball to pass entirely through the net. A keeper is mounted on the rim of the miniature basketball goal and is movable selectively into and out of a position of engagement to hold the ball within the net when desired.

The structure of the rim, in one embodiment of the invention, includes separate upper and lower portions which engage each other securely to attach the rim to the visor of the hat, and the rim, when assembled, holds a separately formed net. Such upper and lower portions of the rim may be interconnected by interlocking flanges and grooves, or by mating threads.

In other embodiments of the invention the net may be formed integrally with the lower portion of the rim.

In one embodiment of the invention the entire rim, including both the upper and lower portions, is formed integrally with the net.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
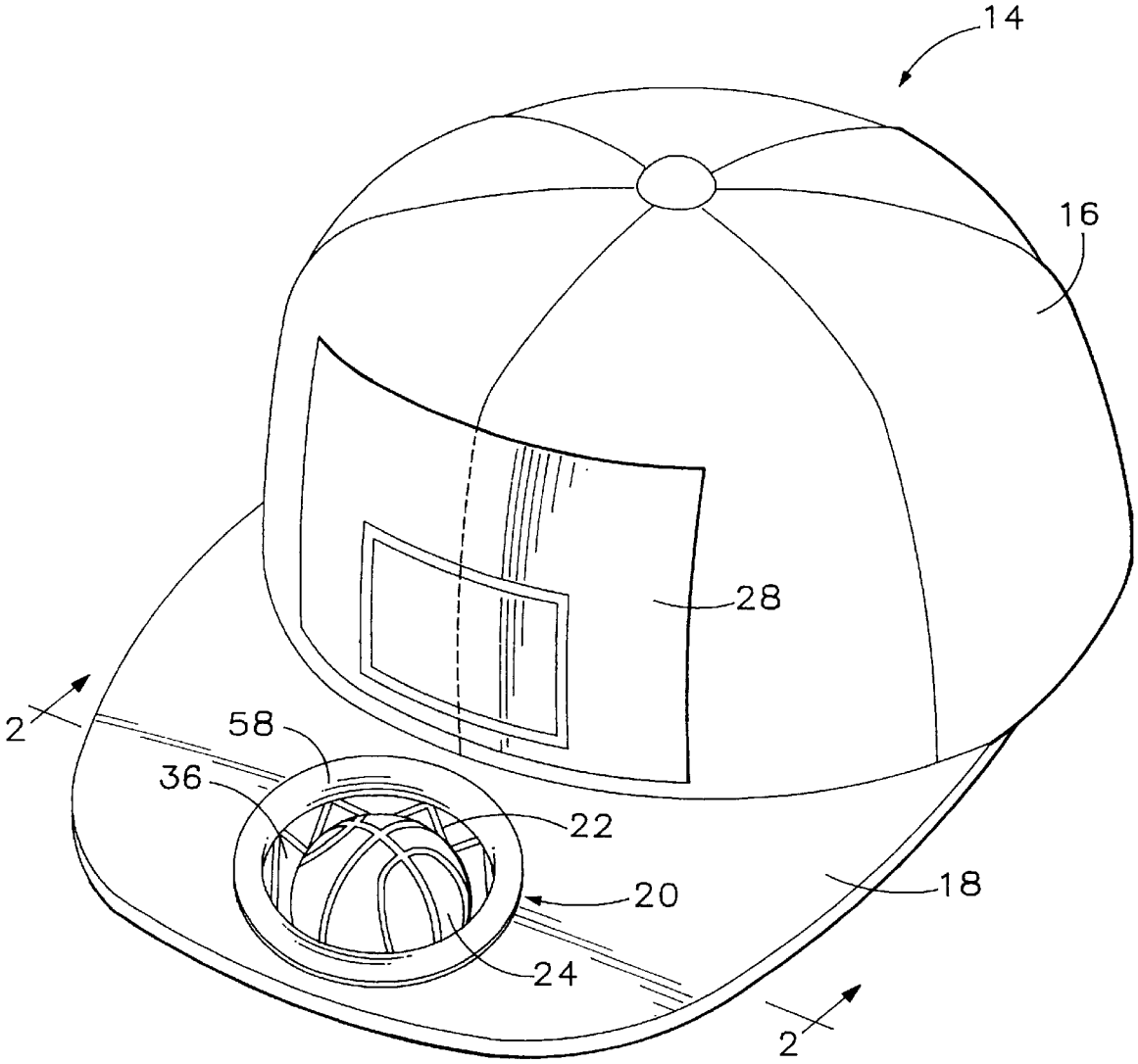
FIG. 1 is a perspective view of a ball cap embodying the present invention, including a miniature basketball goal and a miniature basketball contained within the goal.
Figure 2:
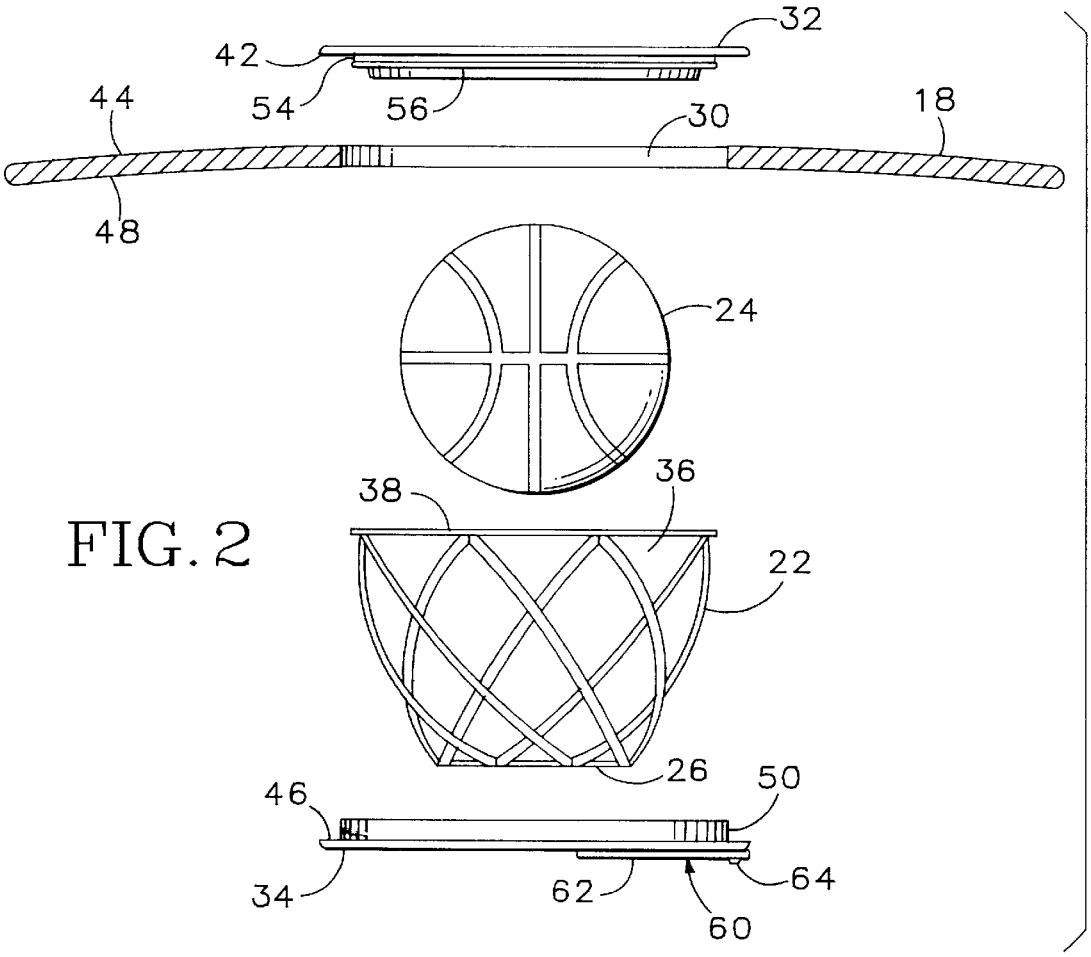
FIG. 2 is an exploded view, at an enlarged scale, of a portion of the ball cap shown in FIG. 1, including a section through its visor, taken along line 2—2.

Referring now to the drawings which form a part of the disclosure herein, a novelty hat 14 embodying the present invention includes a crown 16 and an attached visor 18. A miniature basketball goal is incorporated in the hat, and includes a rim 20 supporting a net 22. A miniature basketball 24 is small enough to pass through the opening defined by the rim 20 and thus to pass into the net 22, but the opening at the bottom 26 of the net is too small to permit the ball 24 to pass through the net entirely. Thus, the hat 14 can be used to play games in which a person wearing the hat 14 attempts to catch the ball 24 in the net 22.

For added similarity to an actual basketball goal, a miniature simulated backboard 28, of cloth, for example, may be fastened to the front of the crown 16 by an adhesive.

Preferably, the net 22 and rim 20 are molded of plastic of suitable strength and flexibility, and the rim 20 is securely attached to the visor 18, extending through a hole 30 defined in the visor 18.

Figure 3:
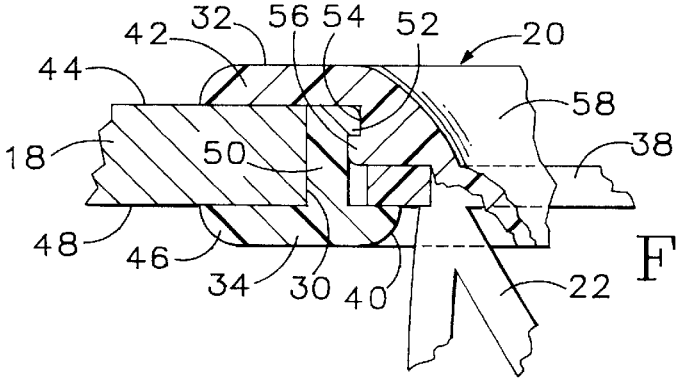
FIG. 3 is a partially cut-away sectional view of a detail of the hat shown in FIG. 1, taken along the line 2—2 at a further enlarged scale.

In one embodiment of the invention, the rim 20 includes an upper portion 32 and a lower portion 34 which fit together securely, with a flange on one of the two portions engaged in a groove defined by the other of the two portions of the rim 20. The upper and lower portions 32 and 34 are made of material which is resilient enough so that such a flange and groove can be forced into mating engagement by resiliently deforming one or both, after which the flange will remain engaged in the groove. As shown in FIG. 3 in greater detail, the upper end or mouth 36 of the net includes an annular rim 38, which is held between the upper portion 32 and the lower portion 34, supported, for example, by a radially inwardly directed flange 40 which is part of the lower portion 34.

Figure 4:
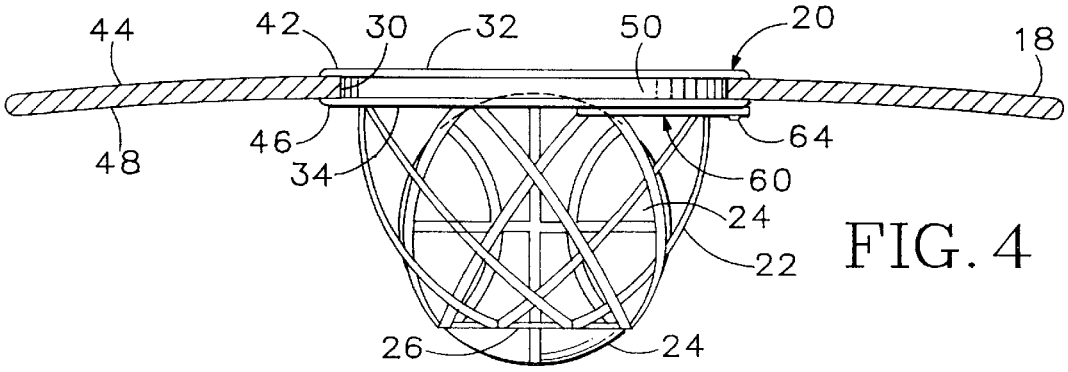
FIG. 4 is a sectional view taken along the line 2–2 of FIG. 1, at an enlarged scale.

Referring also to FIG. 4, the upper portion 32 of the rim 20 includes a radially outwardly directed flange 42 which circumscribes the hole 30 and rests on a top surface 44 of the visor 18. Similarly, the lower portion 34 includes a radially outwardly directed flange 46 which circumscribes the hole 30 and rests against the bottom surface 48 of the visor 18.

Above the flange 46 a generally cylindrical wall 50 which is part of the lower portion 34 extends upwardly within the hole 30 to the bottom of the flange 42. A narrow inwardly directed flange 52 is located at the top of the wall 50 and is received within a corresponding annular groove 54 defined by the upper portion 32, between the bottom of the flange 42 and a narrow radially outwardly directed flange 56. Preferably, both the flange 52 and the flange 56 have rounded edges to facilitate forcing the flange 52 resiliently over the flange 56 and into the groove 54 when assembling the rim 20 in the hole 30.

The upper portion 32 also includes a rounded shoulder 58 which extends smoothly downward from the top of the flange 42 into the mouth 36 of the net 22 to present a pleasing appearance and to help guide the ball 24 into the net 22 during play.

Figure 5:
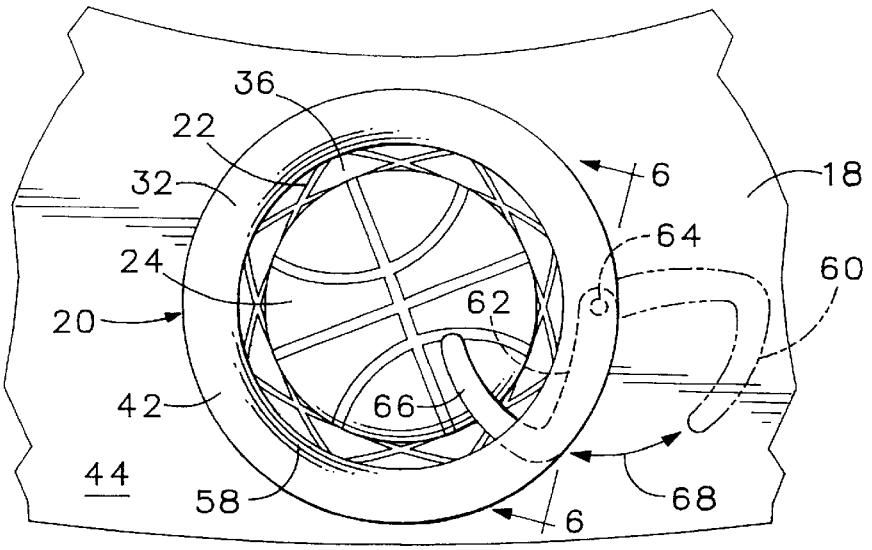
FIG. 5 is a top plan view of a portion of the visor of the hat shown in FIG. 1, together with the miniature net and rim and a keeper holding the miniature ball in the net.
Figure 6:
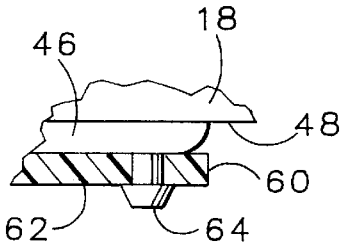
FIG. 6 is a sectional view of a detail of the keeper shown in FIG. 5, taken along line 6—6 at an enlarged scale.

Since the ball 24 might otherwise fall out of the net 22 when the hat is not being used for play, a keeper 60, shown in additional detail in FIGS. 5 and 6, is mounted on the lower portion 34 of the rim 20, where it is normally somewhat hidden from view by the visor 18 when the hat 14 is being worn. The keeper 60 includes an arm 62, mounted rotatably on a pivot pin 64 extending downward from the flange 46 of lower portion 34. A finger 66 carried on the arm 62 extends inwardly within the mouth 36 of the net, above the ball 24, when the keeper 60 is engaged to keep the ball 24 in the net 22.

The shape of the arm 62 conforms with the shape of the lower flange 46, as shown in FIG. 5, to present a neat appearance when the keeper 60 is engaged. The finger 66 is arcuately curved with a radius of curvature equal to the length of the arm 62, so that the finger 66 will easily pass through one of the openings defined by the net 22 as the keeper 60 is pivoted about the pin 64, as indicated by the arrow 68 in FIG. 5, to engage or disengage the keeper 60 as desired.

The pin 64 has an enlarged head which may be formed, for example, by heating the end of the pin 64 and enlarging it as a rivet after the keeper 60 is placed over the pin 64. Alternatively, it would be possible to make the pin 64 and keeper 60 of appropriate relative sizes so that the keeper 60 could be snapped over the head of the pin 64 after its formation.

Figure 8:
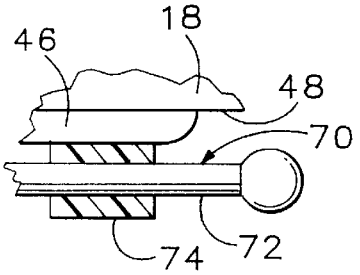
FIG. 8 is a sectional view of a detail of the keeper shown in FIG. 7, taken along line 8—8 at an enlarged scale.
Figure 7:
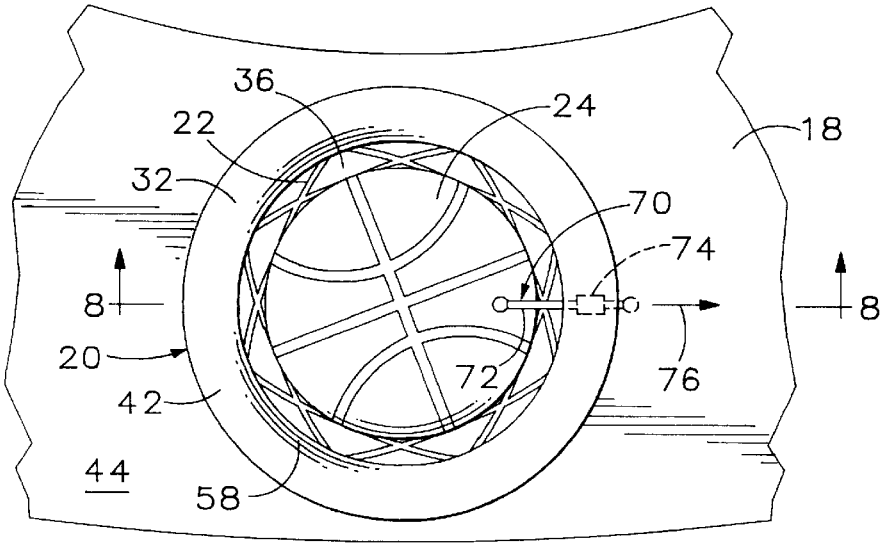
FIG. 7 is a top plan view of a portion of the visor of the hat shown in FIG. 1, showing an alternative keeper holding the ball in the net.

As an alternative to the keeper 60, a keeper 70, shown in FIGS. 7 and 8, consists essentially of a rod 72 carried slidably in a radially directed tube 74 located on the bottom of the lower portion 34 of the rim 20. Each end of the rod 72 is enlarged to prevent the rod 72 from becoming disengaged from the tube 74. When the keeper 70 is engaged, one end of the rod 72 extends within the net 22 near its mouth 36, as shown in FIG. 7, to hold the ball 24 in place inside the net 22. To disengage the keeper 70, the rod 72 is moved outward, as indicated by the arrow 76 in FIG. 7.

Figure 9:
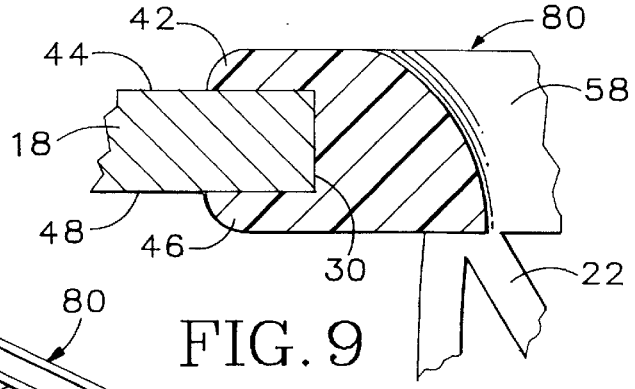
FIG. 9 is a view similar to that of FIG. 3, showing an alternative rim and net structure embodying the invention.
Figure 10:
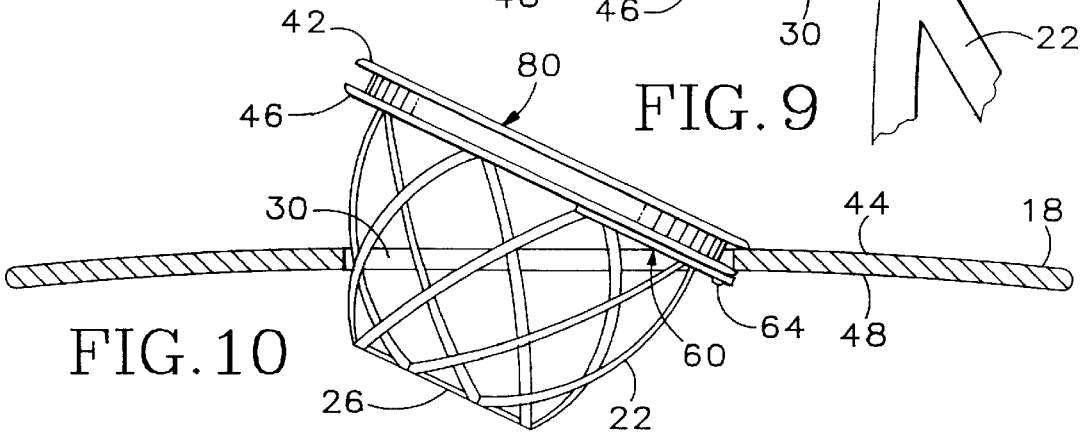
FIG. 10 is a sectional view taken along line 2—2 of FIG. 1, showing a net and rim of the type shown in FIG. 9 during installation into the visor of a cap.

As shown in FIG. 9, as an alternative embodiment of the invention an integral rim 80 is essentially a unitary combination of the rim 20 and net 22 which may be molded of suitable synthetic plastic material with sufficient flexibility and resiliency. The rim 80 is inserted into the hole 30 by resiliently flexing one of the flanges 42 and 46 progressively about its circumference until the entire rim 80, including the integral net 80, is secured in the visor 18. Preferably, insertion begins at the side of the rim 80 where the keeper 60 is mounted, as shown in FIG. 10.

Figure 11:
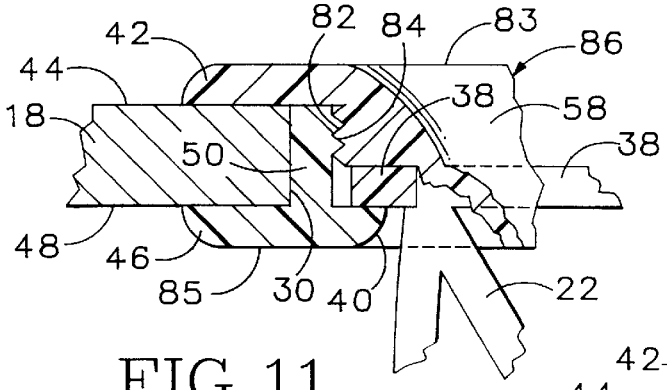
FIG. 11 is a view similar to that of FIG. 3, showing another alternative rim and net structure according to the invention, in which the upper and lower portions of the rim are interconnected by threads.

Referring next to FIG. 11, in another embodiment of the invention, mating helical male and female threads 82 and 84 are formed respectively on the wall 50 of a lower portion 85 and the depending portion of an upper portion 83 of a rim 86 which is otherwise similar to the rim 20 shown in FIGS. 1–4.

Figure 12:
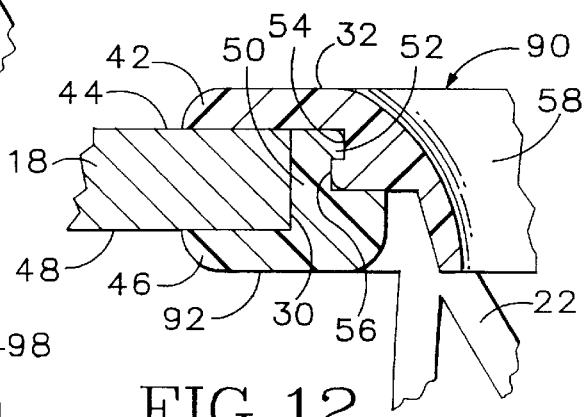
FIG. 12 is a view similar to that of FIG. 3, showing another alternative rim and net structure according to the invention, including a net constructed integrally with a lower portion of a rim similar to that shown in FIG. 3.

A rim 90, shown in FIG. 12, is similar to the rim 20, except that an integral lower portion 92 includes structure combining that of the lower portion 34 shown in FIG. 3 together with the net 22 and its rim 38. The lower portion 92 is mated with an upper portion 32 which is essentially the same as that of the rim 20 shown in FIGS. 1–4.

Figure 13:
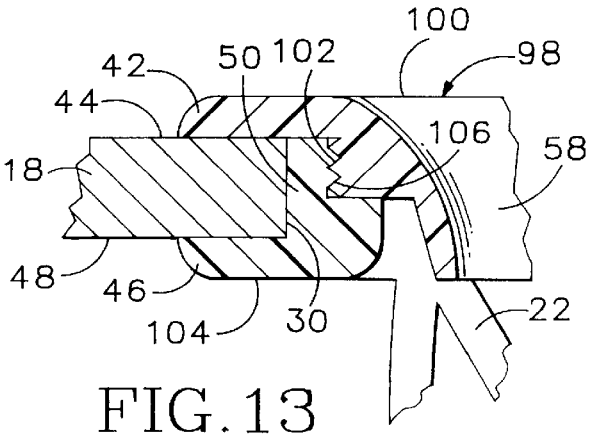
FIG. 13 is a view similar to that of FIG. 3, showing a further alternative structure according to the invention, including a net which is integral with a lower portion of a rim similar to that shown in FIG. 11.

Similarly, as shown in FIG. 13, a rim 98 has an upper portion 100 including a male thread 102 similar to the male thread 82 of the rim 86 shown in FIG. 11. A lower portion 104 of the rim 98 includes a female thread 106 similar to the female thread 84. The lower portion 104, however, includes structure combining the net 22 and its rim 38 as a single integrally molded piece similar, except for inclusion of the thread 106, to the lower portion 92 of the integrated rim and net 90 shown in FIG. 12.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. In a novelty hat including a visor having a top side and a bottom side and having a hole therein, a small net suspended from the visor, and a ball small enough to pass through the hole defined in the visor, an improvement comprising:

said net being of unitary molded construction and being supported by a rim of molded construction mounted within said hole defined in said visor, said rim including an upper portion located on said top side of said visor and circumscribing said hole and a lower portion located on said bottom side of said visor and circumscribing said hole and wherein said upper and lower portions of said rim are separate pieces which engage each other and a portion of said net to support said net beneath said visor and attach said rim to said visor so that said rim extends through said hole.

2. A. The novelty hat of claim 1 wherein said net and said lower portion of said rim are an integral structure.

3. The novelty hat of claim 1 wherein said upper and lower portions of said rim engage each other by resiliently interlocking engagement of a radial flange included on one of said upper and lower portions within a groove defined in the other of said upper and lower portions of said rim.

4. The novelty hat of claim 3 wherein said net and said lower portion of said rim are a single integrally molded piece.

5. The novelty hat of claim 1 wherein said upper and lower portions of said rim engage each other by mating screw threads defined respectively by each of said upper and lower portions.

6. The novelty hat of claim 5 wherein said net and said lower portion of said rim are a single integrally molded piece.

7. The novelty hat of claim 1 wherein said net is integral with one of said upper and lower portions of said rim.

8. The novelty hat of claim 1 wherein at least one of said upper and lower portions of said rim is resiliently flexible and of a size permitting said rim to be installed in said hole by resilient flexure of said resiliently flexible portion.

9. The novelty hat of claim 1 wherein said net is combined with said rim as an integral structure.

10. The novelty hat of claim 1 including a keeper attached to said rim and selectively movable to and from an engaged position in which said keeper holds said ball in said net.

11. The novelty hat of claim 10 wherein said keeper includes an arm pivotally mounted on said rim.

12. The novelty hat of claim 1 wherein said net has a mouth and said upper portion of said rim includes an annular rounded shoulder extending downward within said hole and said mouth.

13. In a novelty hat including a visor having a top side and a bottom side and having a hole therein, a small net suspended from the visor, and a ball small enough to pass through the hole defined in the visor, an improvement comprising:

said net being of unitary molded construction and being supported by a rim of molded construction mounted within said hole defined in said visor, said rim including an upper portion located on said top side of said visor and circumscribing said hole and a lower portion located on said bottom side of said visor and circumscribing said hole and including a keeper having a selectively slidable member mounted on said rim wherein the keeper is selectively moveable to and from an engaged position in which said keeper holds said ball in said net.

* * * * *